US005411782A

United States Patent [19]

Jarvis et al.

[11] Patent Number: 5,411,782

[45] Date of Patent: May 2, 1995

[54] INTERFITTING PLASTIC PANELS

[76] Inventors: Barry M. Jarvis; Carolyn E. Morse, both of 9829 Larston, Houston, Tex. 77055

[21] Appl. No.: 170,034

[22] Filed: Dec. 20, 1993

[51] Int. Cl.[6] ..... B32B 3/00; E04H 3/16

[52] U.S. Cl. ..... 428/57; 52/503; 52/578; 52/580; 52/588.1; 160/229.1; 160/232; 160/233; 160/234; 428/58; 428/188; 428/192

[58] Field of Search ..... 428/57, 58, 188, 192; 52/588.1, 580, 578, 595, 503, 505; 160/229.1, 232, 233, 234; 4/498, 499

[56] References Cited

U.S. PATENT DOCUMENTS

| | | | |
|---|---|---|---|
| 4,065,902 | 1/1978 | Lindal | 52/588.1 |
| 4,577,352 | 3/1986 | Gautheron | 4/499 |
| 4,747,441 | 5/1988 | Apolzer | 160/232 |
| 4,749,606 | 6/1988 | Moore | 428/169 |
| 5,102,253 | 4/1992 | Conti | 52/580 |

*Primary Examiner*—Nasser Ahmad

*Attorney, Agent, or Firm*—Bush, Moseley, Riddle & Jackson

[57] ABSTRACT

A plurality of plastic panels or planks (12) are connected to each other in side by side relation A by interfitting male and female connectors (28, 30) to form a planar structure such as a cover (10). The male connector (28) has opposed outer planar surfaces (32, 34) in contact relation to opposed inner planar surfaces (46, 48) on a female connector (30) to minimize any relative pivoting or articulating movement between adjacent panels (12). Adjacent panel sections (15A, 17B) are hinged to each other about hinges (35E) to permit the panel sections (15A, 17B) to be folded against each other for stacking. Alternatively panels 14C, 14D may be linked together for stacking. A side support (16) is secured to the sides of the cover (10) to cover and to support a side of a panel where such side is not connected to another panel.

13 Claims, 3 Drawing Sheets

INTERFITTING PLASTIC PANELS

BACKGROUND OF THE INVENTION

1. Field of the Invention

This invention relates to interfitting plastic panels, and more particularly to plastic panels or planks comprising a plurality of plastic panels interlocked in side by side relation.

2. Description of the Prior Art

Heretofore, plastic panels or planks have been provided for various structures, such as covers for swimming pools. For example, a plurality of generally similar planks have been formed heretofore of an extruded plastic material, such as polyethylene or polyvinylchloride (PVC) into hollow shapes having edges which are interlocked or connected to each other to form the desired structure.

As an example, reference is made to U.S. Pat. No. 4,577,352 dated Mar. 25, 1986 which shows a cover for a swimming pool having a plurality of hollow extruded plastic sections or planks with each section including a plurality of hollow compartments. Adjacent longitudinally extending sections have interfitting male and female edge portions for connecting adjacent sections together. The interfitting male and female portions, such as tongue and groove connectors, are arcuate and tend to pivot relative to each other about the arcuate joint thereby permitting articulation between adjacent plank sections which may provide an uneven surface appearance to the cover. Adjacent sections are staggered lengthwise for connection of adjacent sections. End plugs are provided to close the ends of the hollow compartments. Because adjacent sections are staggered in order to provide interlocking, at least two different lengths of planks or sections are required.

U.S. Pat. No. 4,749,606 dated Jun. 7, 1988 shows a plurality of floating pads of a hexagonal shape forming a gapless insulating cover for floating on a liquid such as a slurry. The insulating cover prevents heat loss by convection from the surface of the liquid. Each floating pad is formed of a low density polyethylene and has a hexagonal hollow shape.

OBJECTS OF THE INVENTION

An object of the present invention is to provide a plank or panel and a structure formed from a plurality of interfitting planks or panels of extruded plastic material and connected to each other in a manner for maintaining a planar surface without any substantial articulated movement of one panel with respect to its adjacent neighbor.

Another object of this invention is to provide a cover for a swimming pool or spa formed of a plurality of panels characterized by tongue and groove connectors between adjacent panels and restricted articulated movement between panels.

A further object of this invention is to provide such a cover in which the panels may be easily stored or stacked when removed from the pool or spa.

SUMMARY OF THE INVENTION

The present invention is directed to a panel or plank of extruded plastic material and particularly to a planar structure having a plurality of connected panels or planks. The panels are preferably formed of polyethylene or a rigid polyvinylchloride (PVC) material. The panels are of a generally rectangular shape having a width of about one foot, for example, and have a plurality of parallel hollow compartments defined by ribs extending between opposed parallel faces of each panel. The panels have longitudinal slots which function to channel rain water away from the panel. Such slots also give an appearance of a panel having narrow boards connected side by side to a top surface of the panel. If desired, the compartments or cavities of a panel may be filled with a foam or other material which provides strength, insulation, waterproofing and soundproofing.

Opposed sides of each panel extend between the parallel top and bottom faces. One side of each panel has a male connector or fitting while the other opposed side has a female connector or fitting. Adjacent panels are connected with matching male and female connectors in an interfitting relation. Male and female connectors on adjacent panels are formed with opposed coacting planar surfaces in contacting relation with each other to restrict articulated movement between the adjacent panels.

The panels or planks of this invention may be used to construct a cover for a swimming pool or spa. The cover may be constructed such that upon its removal from a swimming pool or spa, sections of the cover may be stored or stacked. For this purpose, a hinge may be provided selectively for adjacent sections of connected panels so that the panel sections may be folded about the hinged connection and stacked on each other. Also, the interfitting male and female connectors between adjacent panels may be modified so that the male connector may be easily disconnected from the female member by relative downward movement of the male connector. The separated panels may then be easily stacked in a stored position.

Other objects, features, and advantages of this invention will become more apparent after referring to the following specification and drawings.

DESCRIPTION OF THE INVENTION

Figure 1:
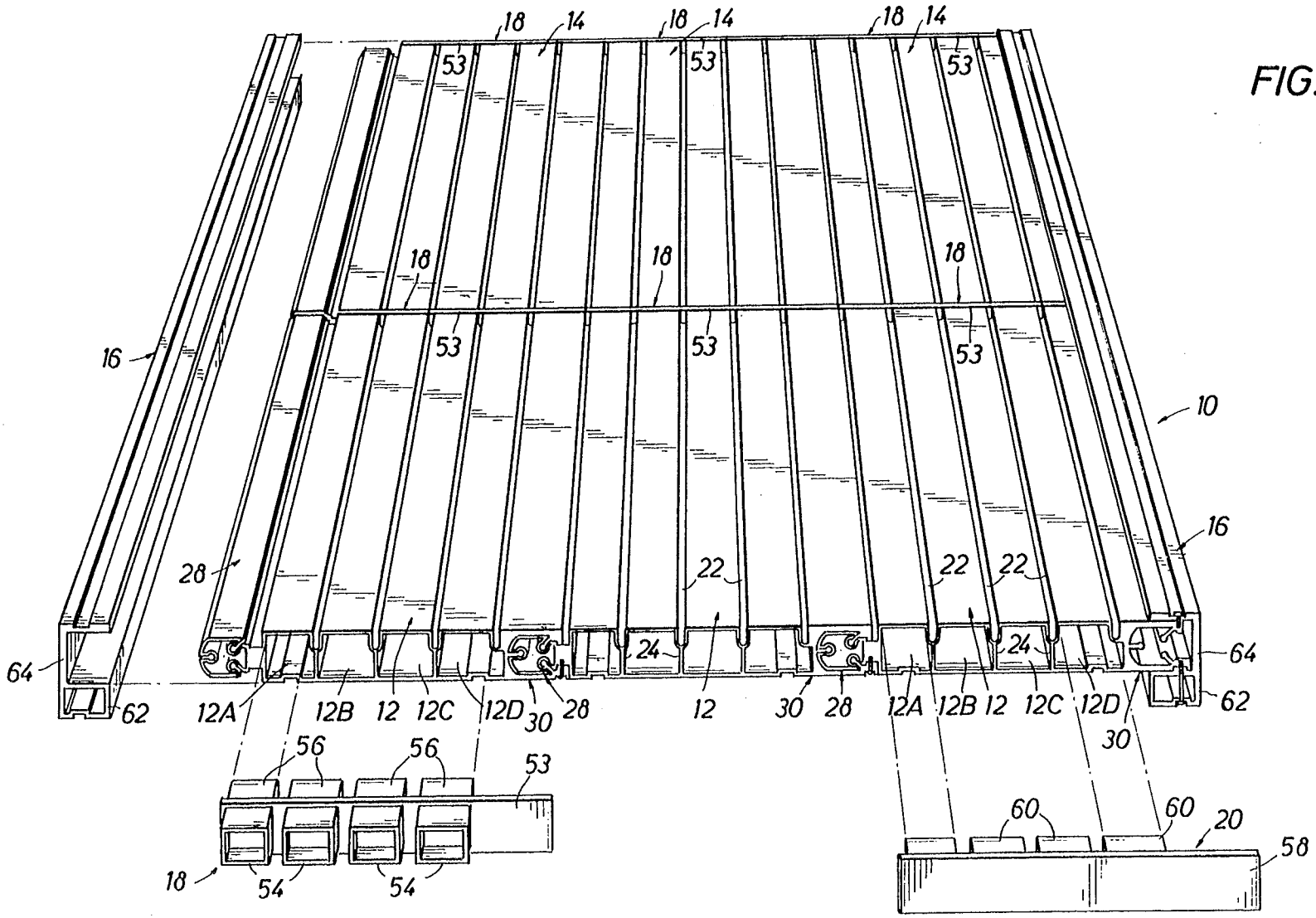
FIG. 1 is a perspective of a plurality of plastic panels of the present invention connected to each other at interfitting male and female connectors to form a cover for a liquid container and illustrating certain members in exploded relation.
Figure 2:
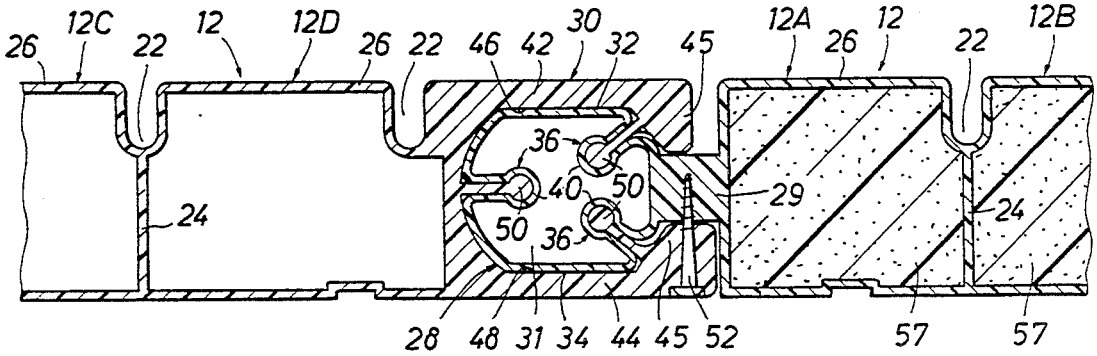
FIG. 2 is an enlarged cross-section of an interfitting male and female connector between adjacent panels to restrict relative pivotal or articulated movement.
Figure 3:
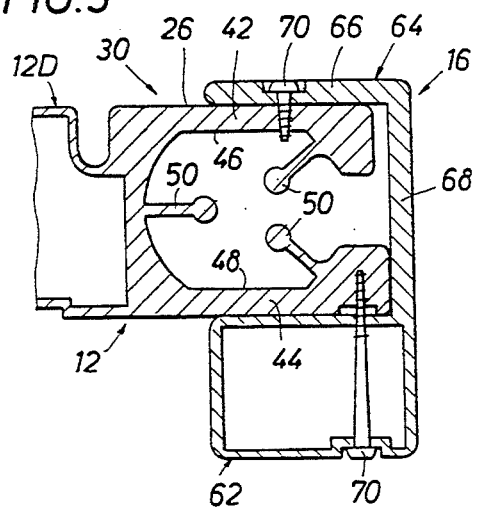
FIG. 3 is an enlarged section of a side support for the cover receiving an adjacent female connector of a panel in supporting relation.

Referring to FIGS. 1-3, a panel or plank 12 is provided which may be interconnected with adjacent panels to form sections of connected panels. Such section in turn may be interconnected to form various useful articles. One such article of the present invention is a cover 10 for a liquid container, such as a swimming pool, spa, or chemical vat. Cover 10 includes a plurality of generally identical extruded plastic panels or planks indicated generally at 12 and 14. (Cover 10 need not necessarily include longitudinally extended planks 14. For certain applications, only side by side planks 12 may be used to form a cover 10). A side or edge support is shown generally at 16 for opposed sides of cover 10. Edge support 16 may be provided not only along the sides of the cover 10 as illustrated in FIG. 1, but also along the front and back ends. An end cap generally shown at 20 in exploded relation in FIG. 1 is provided alternatively for closing open ends of cover 10. Panels 12 and 14 are arranged in an end to end relation. An end to end connector generally indicated at 18 shown in exploded relation is positioned between each pair of panels 12 and 14 to connect the ends of panels 12 and 14 together.

Each plank or panel 12, 14 comprises four, (for example) hollow segments or compartments 12A, 12B, 12C, and 12D defining upper elongate channels or slots 22 therebetween. Fewer or a greater number of these four hollow segments may be provided. Slots 22 permit the flow of a liquid, such as water longitudinally along the length of panels 12, 14. Vertical ribs 24 beneath slots 22 separate compartments 12A-12D for reinforcing panels 12. The upper planar surface of panel 12 is indicated at 26. Panels 12 and 14 are identical. Consequently for the purposes of illustration, only panels 12 are illustrated in detail because panels 14 are of a similar construction.

To connect adjacent panels 12, tongue and groove connections or joints are provided including a male connector or tongue generally indicated at 28 adjacent segment 12A and a female connector or groove generally indicated at 30 adjacent segment 12D. As shown in the enlarged illustration of FIG. 2, male connector 28 includes a body 29 and a projecting hollow head forming cavity 31. Respective upper and lower parallel planar or flat surfaces 32 and 34 are provided on male connector 28. Sockets 36 of male connector 28 extend inwardly into cavity 31. Sockets 36 have an enlarged hollow knob 40 on their inner ends. Three sockets 36 are illustrated, but fewer or greater sockets may be provided.

Female connector 30, also shown in the enlarged illustration of FIG. 2, includes respective upper and lower parallel flanges 42, 44 defining upper and lower inner planar surfaces 46, 48 which are in contact with respective outer planar surfaces 32, 34 of male connector 28. Flanges 42, 44 have inturned lips 45 for engaging the hollow head of male connector 28 to retain male connector 28 within female connector 30 while permitting relative axial (that is, end to end) sliding movement. Solid male extensions 50 on female connector 30 are received within sockets 36 in sliding relation. An externally threaded fastener 52 fits within a suitable opening in lower flange 44 and is threaded within body 29 to secure adjacent panels 12 together after being accurately axially aligned. For positioning adjacent panels 12 in accurate side by side relation, male connector 28 on a panel 12 to be added is first aligned in end to end relation with the adjacent female connector 30 and then moved lengthwise in a sliding axial movement with extensions 50 on female connector 30 being received within hollow sockets 36 on male connector 28.

To connect a pair of panels 12 and 14 in end to end relation, an end connector 18 as shown generally in FIG. 1 has a plate 53 with tubular telescoping portions 54, 56 of a rectangular shape extending from opposite faces of plate 53 for fitting within compartments 12A-12D of adjacent panels 12, 14 in telescoping relation. Suitable fasteners (not shown), such as externally threaded screws or rivets, may be provided to secure panels 12, 14 to telescoping portions 54, 56. The cavities formed by compartments 12A-12D may, if desired, be filled with a suitable foam material such as shown at 57 in FIG. 2 to provide insulation, soundproofing, or waterproofing.

If additional panels are not added in end to end relation to panels 12, it is desirable to close the ends of the open compartments 12A-12D. It is preferred to cover the ends with side or edge supports 16. Alternatively, an end cap 20 may be provided as shown in exploded relation in FIG. 1. End cap 20 has an end plate 58 with tubular portions 60 extending from one face only of end plate 58 for fitting within hollow compartments 12A-12D in close fitting telescoping relation. Suitable fasteners (not shown) may be provided to secure tubular portions 60 within compartments 12A-12D.

A side support 16 is shown in FIG. 3 for supporting and closing a side of cover 10. Side support 16 includes a lower hollow base portion 62 and an integral upper channel-shaped support portion 64 adapted to receive female connector 30. Flange 44 of female connector 30 is supported on base portion 62. Channel-shaped support portion 64 has an upper flange 66 and a web 68. Upper flange 42 of female connector 30 is positioned adjacent upper flange 66 when female connector 30 is received within channel-shaped support 64. Externally threaded fasteners 70 extend through suitable openings in side support 16 for threading within flanges 42 and 44 of female connector 30 for securement of side support 16 to panel 12. Side support 16 is preferably of a length equal to the entire side of cover 10.

Figure 4:
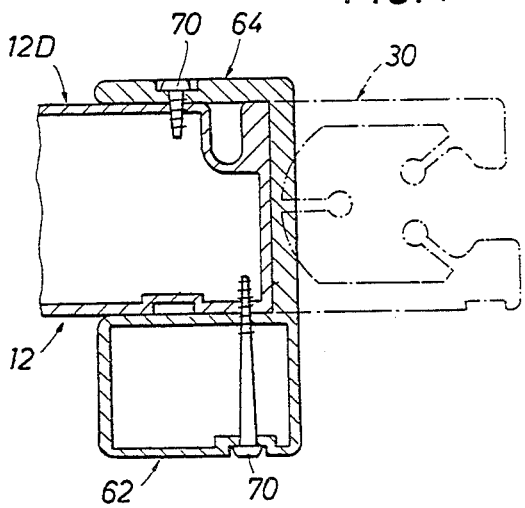
FIG. 4 is an enlarged section of a modified side support similar to the embodiment of FIG. 3 but showing the side support supporting the adjacent side of a panel in which the female connector has been removed.

Referring to FIG. 4, side support 16 is shown connected directly to segment or compartment 12D of panel 12. Female connector 30 has been removed by sawing or cutting from adjacent compartment 12D and side support 12 is received within channel-shaped support 64 for support on base portion 62. Fasteners 70 are threaded through the upper and lower walls of compartment 12D for securing of side support 16. If side support 16 is positioned on the opposed side of cover 10 the adjacent male connector 28 is removed to permit support of adjacent compartment 12A directly on base portion 62. If male connector 28 is supported on base portion 62, suitable inserts may be placed on surfaces 32 and 34 to provide a tight fit of male connector 28 within side support 16.

Relative pivotal or articulated movement between male connector 28 and interfitting female connector 30 of adjacent panels 12 is minimized by the present invention. Outer planar or flat surfaces 32 and 34 of male connector 28 are in contact relation with inner planar or flat surfaces 46, 48 of female connector 30 thereby to limit relative pivotal or articulated movement between adjacent panels 12 so that a smooth planar surface is provided for cover 10. Additionally, extensions 50 on female connector 30 are received in telescoping relation within hollow sockets 36 on male connector 28 to further minimize any relative transverse movement between adjacent panels 12.

Figure 6:
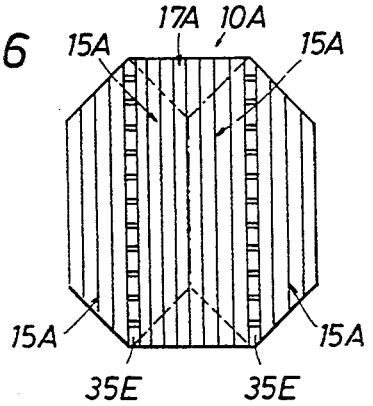
FIG. 6 is a top plan view of an entire cover illustrated diagrammatically which illustrates an embodiment in which hinged side panel sections are designed and arranged for folding over a center panel for storage.
Figure 7:
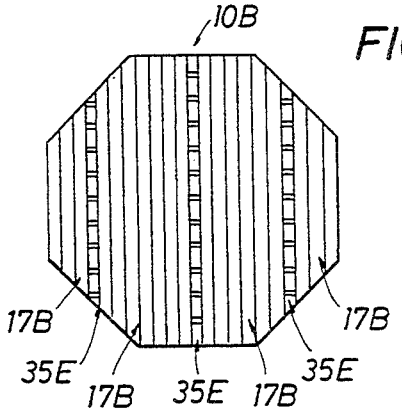
FIG. 7 is a top plan view of another hinged cover in which a plurality of hinged panel sections of the same width are shown for folding together in an accordion fold for storage.
Figure 5:
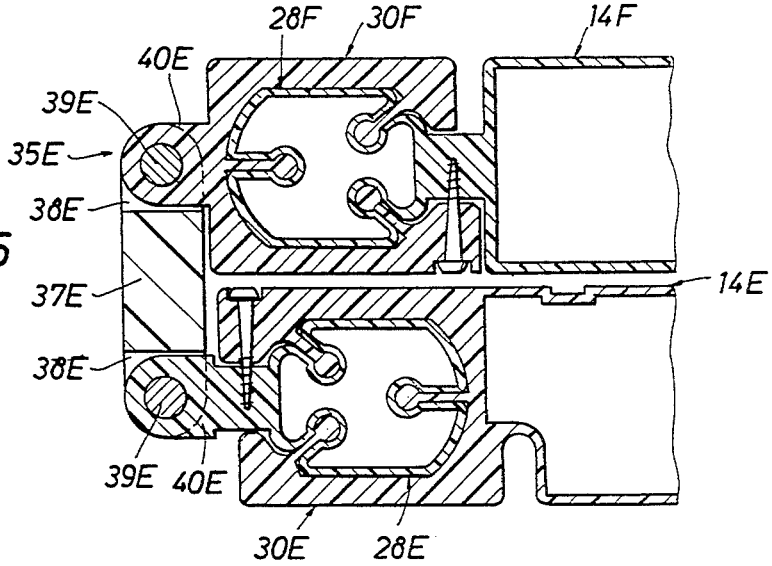
FIG. 5 is an enlarged section of a hinged connection between adjacent panel sections to permit folding of adjacent structures or sections for storage.

Referring to FIGS. 5–7 and more particularly to FIG. 5, a modification of the present invention is shown in which adjacent panels 14E and 14F are hinged for folding over each other for stacking or storage of the cover. Panel 14F has a male connector 28F thereon and adjacent panel 14E has an interfitting female connector 30E thereon as in the embodiment shown in FIGS. 1–3. A hinge between panels 14E and 14F is shown generally at 35E and includes a male connector 28E, a female connector 30F, and a link 37E extending between male connector 28E and female connector 30F. Link 37E has opposed lugs 38E spaced at intervals along the length of panels 14E and 14F. Mating lugs 40E on male connector 28E and female connector 30F have openings aligned with openings in lugs 38E. Pins 39E extend through the aligned openings in lugs 38E and 40E to mount panels 14E and 14F for relative hinged movement to the position shown in FIG. 5 in which panel 14F is in a stacked position over panel 14E.

Referring to FIG. 6, a cover 10A is shown diagrammatically in which a pair of side panel sections are shown generally at 15A with each side panel section 15A including a plurality of connected interfitting panels. Such panels have been sawed, for example to produce the angular shaped side sections 15A. (Sections of any shape may be formed by sawing, cutting or otherwise forming.) A center panel section is shown at 17A with side sections 15A hinged to center section 17A about hinges 35E. For storage, side sections 15A may be folded about hinges 35E over center section 17A as shown in broken lines. The width of each side section 15A (for example) may be about one half the width of center section 17A.

Referring to FIG. 7, a modification of a hinged cover is shown at 10B with a plurality of panel sections 17B of the same width with each panel section 17B including a plurality of interfitting panels. Sections 17B are connected to each other along hinges 35E. Cover 10B for storage may be folded about hinges 35E in an accordion fold. The folded sections 17B may then be stored.

Hinge 35E does not provide a continuous upper planar surface with the adjacent panels. If desired, the thickness of link 37E may be increased so that the upper surface of link 37E is in the same plane as the upper surfaces when panels 14E and 14F are spread out side-by-side.

Figure 8:
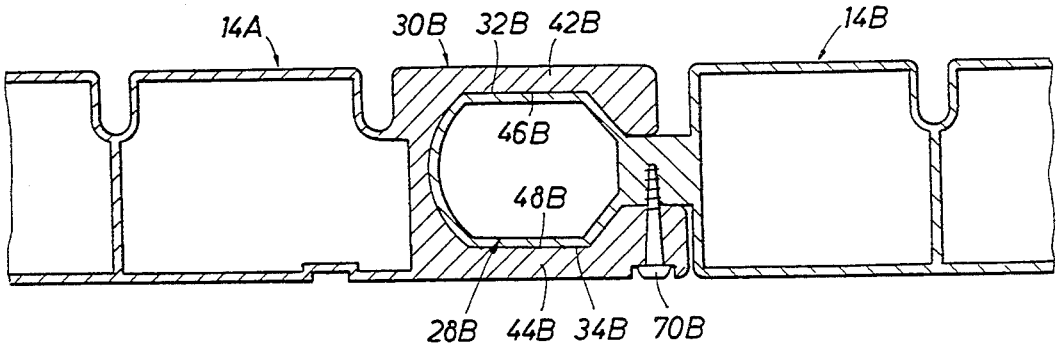
FIG. 8 is an enlarged section of a modified interfitting male and female connectors of adjacent panels.

Referring to FIG. 8, another embodiment of an interlocking connection between adjacent panels is illustrated in which panels 14A, 14B are provided generally identical to panels 12 of the embodiment of FIGS. 1–3 except for the interlocking connection. Panel 14A has a female connector 30B; and panel 14B has a male connector 28B. Female connector 30B has upper and lower flanges 42B, 44B. Flanges 42B, 44B have respective inner planar or flat surfaces 46B and 48B. Male connector 28B has a hollow head which defines respective outer parallel planar surfaces 32B and 34B which, when connected to female connector 42B, contacts inner surfaces 46B and 48B so as to minimize relative pivotal or articulated movement between adjacent panels 14A and 14B. A suitable fastener 70B secures male connector 28B to female connector 30B when panels 14A and 14B are properly aligned in end to end relation. The embodiment of FIG. 8 does not include any additional interfitting members as in the embodiment of FIGS. 1–3.

Figure 9:
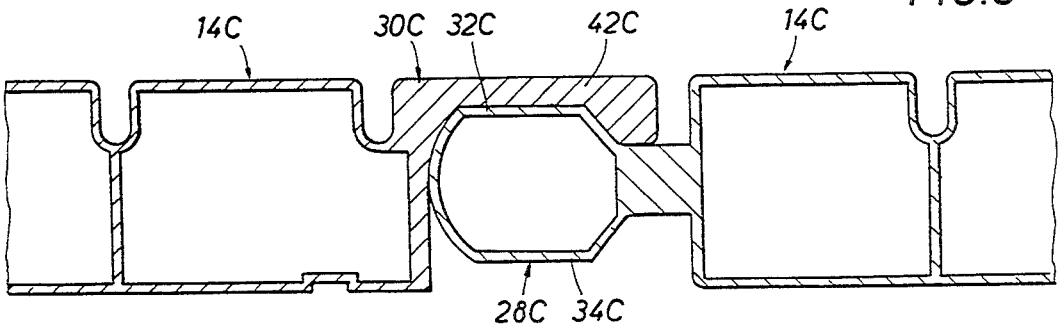
FIG. 9 is an enlarged section of a further modified interfitting male and female connector of adjacent panels in which a lower portion of the female connector has been removed to facilitate detachment and attachment of adjacent panels.

Referring to FIG. 9, another embodiment of an interlocking connector between adjacent panels is illustrated in which adjacent panels 14C and 14D are provided. Panel 14D has a male connector 28C including parallel outer planar surfaces 32C and 34C. Panel 14C has a female connector 30C with an upper flange 42C overlying male connector 28C. No lower member or flange on female connector 30C extends beneath male connector 28C. For assembly of interfitting male connector 28C and female connector 30C of adjacent panels 14D and 14C, it is not necessary to move panels 14C and 14D lengthwise as the interfitting relation between male connector 28C and female connector 30C may be obtained with a sidewise or transverse movement to position male connector 28C beneath flange 42C. Thus, panels 14C and 14D may be connected and disconnected in a minimum period of time.

The preferred material for the panels of the invention described above is high density polyethylene or rigid polyvinylchloride (PVC), which may be easily extruded into hollow portions or sections to provide lightweight plastic members. The material may be provided with any desired color. The panels may be impregnated or coated with heat or solar reflective particles, if desired. Also, the panels may be coated, if desired, with a colorless heat reflective paint or emulsion. The top surface may be extruded to form a grained surface, if desired.

While the present invention has been illustrated in the drawings as a cover for a liquid container, such as a swimming pool, spa, or chemical vat, it is to be understood that the present invention may be used as a vertically extending fence or barrier as may be desirable, such as for a sound barrier. When utilized as a fence or sound barrier, it is desirable to have vertical supports, such as metal or plastic posts imbedded in the supporting surface to provide adequate support for the fence or barrier.

The advantages and features of this invention are many:

(1) The interlocking component 12 may be formed in any shape or any length, with a planar structure of any width being created by interlocking such components. The use of the structure may determine the appropriate width. For example sections for a pool cover may be of different widths than for sound barrier or fences, etc.

(2) Once the components 12 are interconnected into a larger section, such section may be cut, sawed or otherwise formed into sections of arbitrary shape. In other words, such sections become a building material structure, much like a sheet of plywood which may be cut to any shape depending on its purpose.

(3) The component 12 may be assembled quickly and efficiently into a section with no tools or special expertise on the part of a workman.

(4) The components, and the section made from interlocked (interconnected) components, have interior cavities which may be filled with foam or other materials to impart properties of buoyancy, insulation, soundproofing to a section which results from interconnecting components 12. Accordingly, the sections may have different properties from one another, depending on the material properties which fill the cavities of the components.

(5) The individual components, and the sections which result from interconnecting of such cavities, have rigidity and stiffness by virtue of the ribs which separate top and bottom surfaces of the components into cavities. Such construction, resembling a honey comb structure, provides such stiffness and rigidity.

(6) Unlike plywood sections which deteriorates when exposed to sunlight, water, and corrosive materials, the plastic material used to form sections of the invention may be made resistant to water, ultra violet (UV) rays of the sun and corrosiveness of certain chemicals. Accordingly, interconnect component sections may be used as a cover for a swimming pool, as a cover for a chemical vat, or for any number of other uses where water, UV or chemicals contact a section. The sections are also resistant to deterioration due to temperature changes.

(7) The hinges of the invention provide a way for sections to be folded so that a cover (e.g. spa or swimming pool cover), or the like may be stored in a convenient place.

(8) The components 12 are of a weight so that a person may easily handle one component as he assembles a section from such components. In other words, a person may assemble a section at a place of intended use, rather than transport entire sections of heavy weight and large size from a manufacturing location. Such sections which result from assembly of components (12) may be stacked one on top of another for convenient storage.

(9) The components 12 and the sections which result from assembly of such components may be of any color by adding various color dyes into the plastic while the components are formed. Similarly the top surface of the component 12 may be impregnated or coated with heat and/or solar reflective particles or it can be coated with a colorless heat reflective paint or emulsion.

(10) A section assembled from components 12 may be sealed about its peripheral edges with edge rails or end caps as discussed above.

(11) End caps 20 as shown in FIG. 1 not only function to seal the end of a section, it also serves to add stability to assembled components. Edge supports 16 may also seal and cover the end of a section.

(12) Components 12 and hinges 35E after being interconnected with other components may be fixed with respect to each other by means of screws or rivets.

(13) The grooves 22 on top of the components function to channel water away from the surface of a section of assembled components. Such grooves also provide a pleasing look of narrow boards being provided next to each other on the top of the surface.

Since certain changes or modifications may be made in the disclosed embodiments without departing from the inventive concepts involved, the appended claims are intended to cover all such changes and modifications falling within the true spirit and scope of the present invention.

What is claimed is:

1. A planar structure comprising:

a plurality of interfitting panels of an extruded material extending in a common plane in side by side relation; each of said panels having opposed parallel faces connected by opposed sides and having a plurality of parallel hollow compartments therein, each of said panels having a generally rectangular shape and a plurality of longitudinally extending parallel grooves in the upper surface of said panels;

one of said sides of each panel having a male connector thereon and the other side having a female connector thereon, said male and female connectors on adjacent panels being in interfitting relation;

cooperating means on said interfitting male and female connectors restricting relative articulated movement therebetween while forming said planar structure, wherein said female connector includes upper and lower flanges with a groove therebetween to receive the male connector, additional mutually interfitting extensions and hollow sockets located on said flanges and on said male connector; and an edge support structure having a longitudinal channel adapted to fit about a side or end of said structure.

2. A planar structure as set forth in claim 1 wherein:

said cooperating means on said interfitting male and female connectors of adjacent panels includes complementary planar surfaces on said male and female connectors in contacting relation with each other to block relative articulated movement between said adjacent panels.

3. A planar structure as set forth in claim 2 wherein:

said planar surfaces on said male and female connectors are parallel to each other.

4. A planar structure as set forth in claim 1 wherein:

a second plurality of additional interfitting panels are positioned in end to end aligned relation with said first mentioned plurality of interfitting panels, and an end connector is positioned between each pair of aligned panels, said end connector having a center plate and a plurality of tubular extensions extending from opposed sides of said center plate, said tubular extensions being received in telescoping close fitting relation within compartments of said pair of aligned panels for connecting said pairs of aligned panels in end to end relation.

5. A cover adapted to fit over a container for liquids comprising:

a plurality of interfitting panels of an extruded material having a generally rectangular shape having upper and lower surfaces and opposed edges extending between said surfaces, each of said panels having a plurality of parallel hollow compartments therein;

interfitting male and female connectors on said opposed edges of said panels;

means on said interfitting connectors to restrict relative articulated movement between adjacent interfitted panels;

said female connector including an upper flange and a lower flange defining a groove therebetween to receive male side connector, said female connector having extensions between said inner and outer flanges; and interfitting hollow sockets on said male connector receiving said extensions when said male and female connectors are in interfitting relation.

6. A cover as set forth in claim 5 wherein:

said male and female connectors have interfitting coacting planar portions thereon to form said means to restrict relative articulated movement between said panels.

7. A cover as set forth in claim 5 wherein:

a plurality of ribs extend between said upper and lower surfaces and define said plurality of parallel hollow compartments therein; and longitudinal grooves extend along an upper surface of at least some of said panels over subjacent ribs of said panels thereby providing a channel for the flow of water along the upper surface of said cover.

8. A cover adapted to fit over a container for liquids comprising:

a plurality of interfitting panels of an extruded material having a generally rectangular shape having upper and lower surfaces and sides extending between said surfaces, and having a plurality of parallel hollow compartments therein and a plurality of longitudinally extending parallel grooves in the upper surface of said panels;

interfitting male and female members connecting said plurality of panels together in side by side relation to form a plurality of panel sections, wherein said female connector includes upper and lower flanges with a groove therebetween to receive the male connector, additional mutually interfitting extensions and hollow sockets located on said flanges and on said male connector; and a hinge extending between and pivotally connected to opposed sides of a pair of adjacent panel sections, said hinge permitting said pair of adjacent panel sections to be folded over each other to permit vertical stacking of said pair of panel sections in contacting horizontal layers;

said hinge including a pivotally mounted link extending between male and female members of adjacent panel sections.

9. A cover as set forth in claim 8 wherein:

a plurality of fibs extend between said upper and lower surfaces of said pairs of panels to define said plurality of hollow compartments therein, said grooves being in vertical alignment with said ribs.

10. A generally horizontally extending cover adapted to fit over a container comprising:

a plurality of interfitting panels of an extruded material having a generally rectangular vertical cross section and having upper and lower surfaces and opposed sides extending between said surfaces, having a plurality of parallel hollow compartments therein and a plurality of longitudinally extending grooves in the upper surface of said panel;

one of said sides having a male connector and another of said sides having a female connector thereon;

wherein said female connector includes upper and lower flanges with a groove therebetween to receive the male connector, additional mutually interfitting extensions and hollow sockets located on said flanges and on said male connector; and said male and female connectors of adjacent panels fitting together and capable of being removed from each other by relative vertical movement between said male and female connectors, whereby said adjacent panels may be disengaged for disassembly of said adjacent panels.

11. A cover adapted to fit over a container for liquids comprising:

a plurality of connected panels of an extruded material having a generally rectangular shape having upper and lower surfaces and opposed edges extending between said surfaces, each of said panels having a plurality of parallel hollow compartments therein;

interfitting male and female connectors on said opposed edges of said panels;

means on said interfitting connectors to restrict relative articulated movement between adjacent interfitted panels;

said female connector including an upper flange and a lower flange defining a groove therebetween to receive said male connector, said upper and lower flanges of said female connector having parallel inner planar surfaces in opposed relation to each other fitting against said male connector when in interfitting relation;

said male connector having opposed outer planar surfaces in complementary relation to said inner planar surfaces of said female connector when in interfitting relation thereby to restrict articulated movement between said male and female connectors;

said female connector having extensions between said inner and outer flanges, and interfitting hollow sockets on said male connector receiving said extensions when said male and female connectors are in interfitting relation thereby to restrict articulated movement between adjacent panels.

12. A cover adapted to fit over a container for liquids comprising:

a plurality of interfitting panels of an extruded material having a generally rectangular shape having upper and lower surfaces and opposed edges extending between said surfaces, each of said panels having a plurality of parallel hollow compartments therein and having a plurality of longitudinally extending parallel grooves in the upper surface of said panels;

interfitting male and female connectors on said opposed edges of said panels;

means on said interfitting connectors to restrict relative articulated movement between adjacent interfitted panels, wherein said female connector includes upper and lower flanges with a groove therebetween to receive the male connector, additional mutually interfitting extensions and hollow sockets located on said flanges and on said male connector;

said plurality of panels including a plurality of panels aligned in end to end relation; and a joint connector between each pair of panels aligned in end to end relation, said joint connector fitting within axially aligned hollow compartments of the aligned panels and connecting each pair of panels to each other in end to end relation.

13. A cover as set forth in claim 12 wherein:

said joint connector has a center plate and a plurality of tubular extensions extending from opposed sides of said center plate, said tubular extensions being received in telescoping close fitting relation within said axially aligned hollow compartments of adjoining panels in end to end relation.

* * * * *